US007000505B2

(12) United States Patent
Hsien

(10) Patent No.: US 7,000,505 B2
(45) Date of Patent: Feb. 21, 2006

(54) SOCKET

(76) Inventor: Chih-Ching Hsien, 58, Ma Yuan West St., Taichung (TW)

( * ) Notice: Subject to any disclaimer, the term of this patent is extended or adjusted under 35 U.S.C. 154(b) by 0 days.

(21) Appl. No.: 10/666,969

(22) Filed: Sep. 19, 2003

(65) Prior Publication Data

US 2005/0061116 A1 Mar. 24, 2005

(51) Int. Cl.
*B25B 13/06* (2006.01)

(52) U.S. Cl. ..... 81/121.1; 81/124.3; 81/124.6

(58) Field of Classification Search ..... 81/177.2, 81/60–63.2, 185, 124.7, 124.6, 124.3, 121.1, 81/186, 124.5

See application file for complete search history.

(56) References Cited

U.S. PATENT DOCUMENTS

| | | | | |
|---|---|---|---|---|
| 2,651,230 A * | 9/1953 | Waterval | ..... | 81/124.3 |
| 3,299,750 A * | 1/1967 | Campanile et al. | ..... | 81/62 |
| 5,295,422 A * | 3/1994 | Chow | ..... | 81/124.3 |
| 5,819,606 A * | 10/1998 | Arnold | ..... | 81/124.3 |
| 5,901,620 A * | 5/1999 | Arnold | ..... | 81/63.2 |
| 6,389,931 B1 * | 5/2002 | Delaney et al. | ..... | 81/60 |

* cited by examiner

*Primary Examiner*—Lee D. Wilson
*Assistant Examiner*—Alvin J. Grant

(57) ABSTRACT

A socket includes a main body including a first cylinder having an outer periphery formed with a plurality of outer teeth, and a second cylinder having an inner periphery formed with a plurality of inner teeth. The inner teeth of the main body and the outer teeth of the main body have the same tooth number and have the corresponding tooth shape. Thus, the sockets can co-operate with each other to increase the working length, and the sockets co-operating with the ratchet wrench can be used in an elongated shallower space.

1 Claim, 5 Drawing Sheets

SOCKET

BACKGROUND OF THE INVENTION

1. Field of the Invention

The present invention relates to a socket, and more particularly to a socket including inner teeth and outer teeth having the same tooth number and have the corresponding tooth shape.

2. Description of the Related Art

A conventional socket 40 in accordance with the prior art shown in FIG. 5 comprises a main body 42 having a greater length, so that the socket 40 co-operating with a ratchet wrench (not shown) can be used in an elongated shallower space. However, the main body 42 has a greater length, so that the socket is easily deformed or distorted due to an excessive torque, thereby decreasing the lifetime of the conventional socket 40.

SUMMARY OF THE INVENTION

The primary objective of the present invention is to provide a socket including inner teeth and outer teeth having the same tooth number and have the corresponding tooth shape.

Another objective of the present invention is to provide a socket, wherein the twelve outer teeth of the main body of the socket mesh with the twelve inner teeth of the drive head of the ratchet wrench, so that the driving torque of the drive head of the ratchet wrench is distributed to the twelve outer teeth of the main body of the socket and the twelve inner teeth of the drive head of the ratchet wrench evenly and smoothly, without producing a stress concentration effect, thereby preventing the main body of the socket and the drive head of the ratchet wrench from being broken or worn out due to an excessive torque so as to increase the lifetime of the socket and the ratchet wrench.

A further objective of the present invention is to provide a socket, wherein the inner teeth of the main body and the outer teeth of the main body have the same tooth number and have the corresponding tooth shape, so that the sockets can co-operate with each other to increase the working length, and the sockets co-operating with the ratchet wrench can be used in an elongated shallower space.

In accordance with the present invention, there is provided a socket, comprising a main body including a first cylinder, and a second cylinder integrally formed on the first cylinder, wherein:

the first cylinder of the main body has an outer periphery formed with a plurality of outer teeth;

the second cylinder of the main body has an inner periphery formed with a plurality of inner teeth;

the inner teeth of the second cylinder of the main body and the outer teeth of the first cylinder of the main body have the same tooth number and have the corresponding tooth shape.

Further benefits and advantages of the present invention will become apparent after a careful reading of the detailed description with appropriate reference to the accompanying drawings.

DETAILED DESCRIPTION OF THE INVENTION

Figure 1:
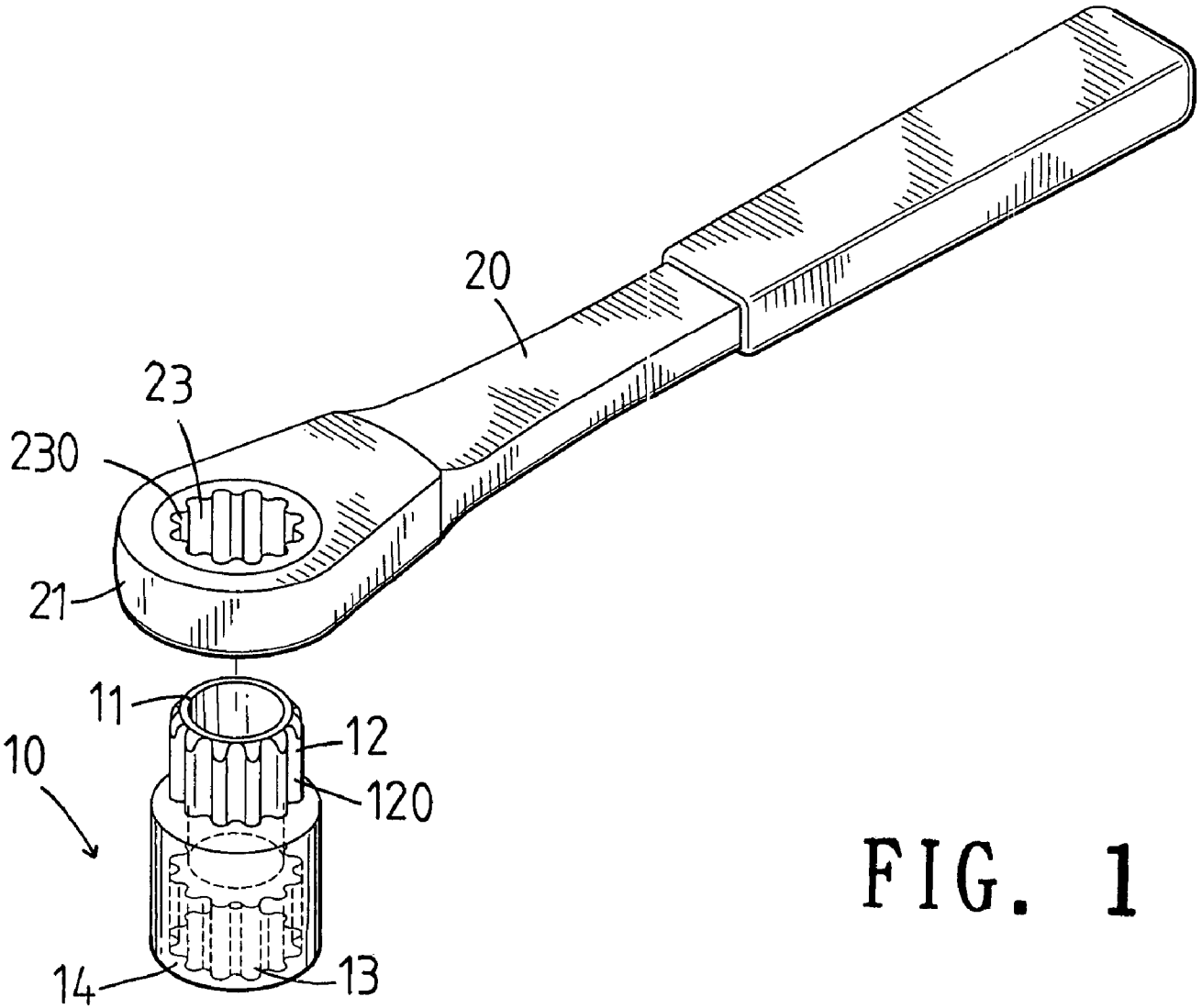
FIG. 1 is a perspective view of a socket and a ratchet wrench in accordance with the preferred embodiment of the present invention.
Figure 2:
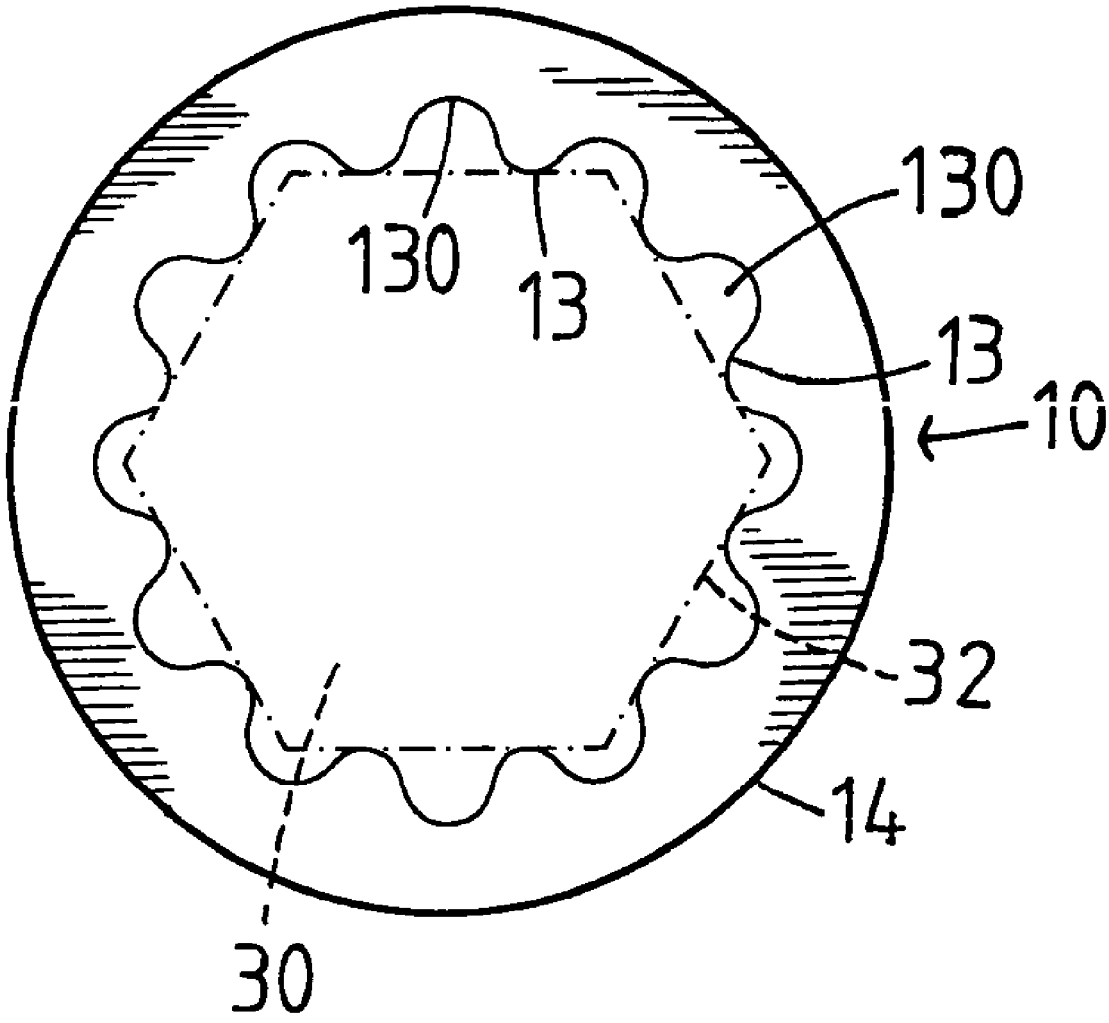
FIG. 2 is a bottom plan view of the socket as shown in FIG. 1.

Referring to the drawings and initially to FIGS. 1 and 2, a socket in accordance with the preferred embodiment of the present invention comprises a main body 10 including a first cylinder 11, and a second cylinder 14 integrally formed on the first cylinder 11.

The first cylinder 11 of the main body 10 has an outer periphery formed with a plurality of arcuate outer teeth 12. Preferably, the first cylinder 11 of the main body 10 is formed with twelve outer teeth 12 which are arranged in an annular manner. In addition, the outer periphery of the first cylinder 11 of the main body 10 is formed with a plurality of arcuate recesses 120 located between the outer teeth 12. Preferably, the first cylinder 11 of the main body 10 is formed with twelve recesses 120.

The second cylinder 14 of the main body 10 has an inner periphery formed with a plurality of arcuate inner teeth 13. Preferably, the second cylinder 14 of the main body 10 is formed with twelve inner teeth 13 which are arranged in an annular manner. In addition, the inner periphery of the second cylinder 14 of the main body 10 is formed with a plurality of arcuate recesses 130 located between the inner teeth 13. Preferably, the second cylinder 14 of the main body 10 is formed with twelve recesses 130.

Preferably, the inner teeth 13 of the second cylinder 14 of the main body 10 and the outer teeth 12 of the first cylinder 11 of the main body 10 have the same tooth number and have the corresponding tooth shape.

In addition, a ratchet wrench 20 includes a drive head 21 having an inner periphery formed with a plurality of arcuate inner teeth 23. Preferably, the drive head 21 of the ratchet wrench 20 is formed with twelve inner teeth 23. The inner periphery of the drive head 21 of the ratchet wrench 20 is formed with a plurality of arcuate recesses 230 located between the inner teeth 23. Preferably, the drive head 21 of the ratchet wrench 20 is formed with twelve recesses 230.

Figure 3:
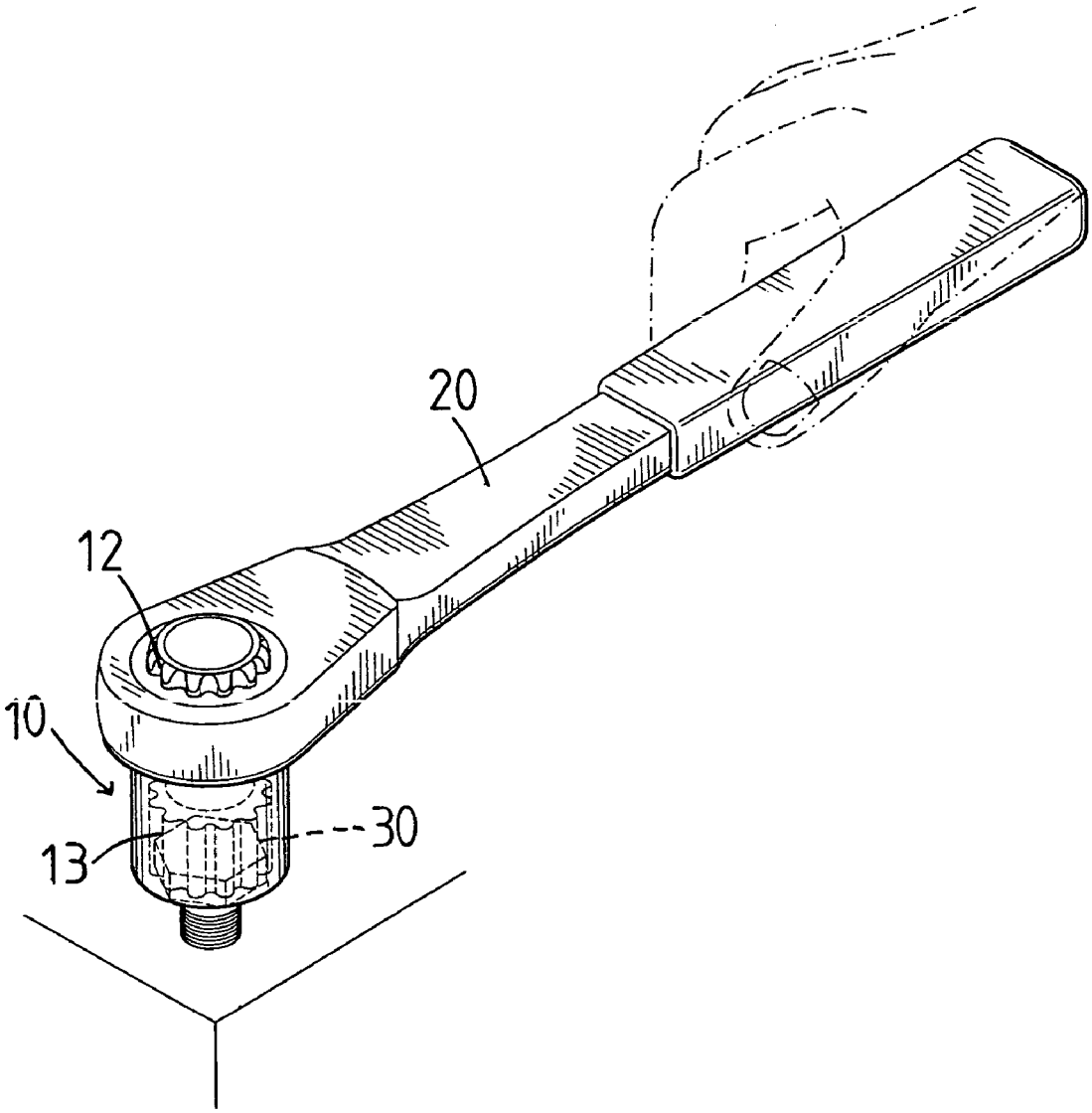
FIG. 3 is a perspective assembly view of the socket and the ratchet wrench as shown in FIG. 1.

In operation, referring to FIGS. 1–3, the drive head 21 of the ratchet wrench 20 is mounted on the first cylinder 11 of the main body 10, with the twelve outer teeth 12 of the first cylinder 11 of the main body 10 meshing with the twelve inner teeth 23 of the drive head 21 of the ratchet wrench 20. Then, the second cylinder 14 of the main body 10 is mounted on a workpiece, such as a nut 30, with the twelve inner teeth 13 of the second cylinder 14 of the main body 10 being rested on the six faces 32 of the nut 30. Thus, when the drive head 21 of the ratchet wrench 20 is rotated, the main body 10 of the socket is rotated so as to rotate the nut 30 as shown in FIG. 3.

Figure 4:
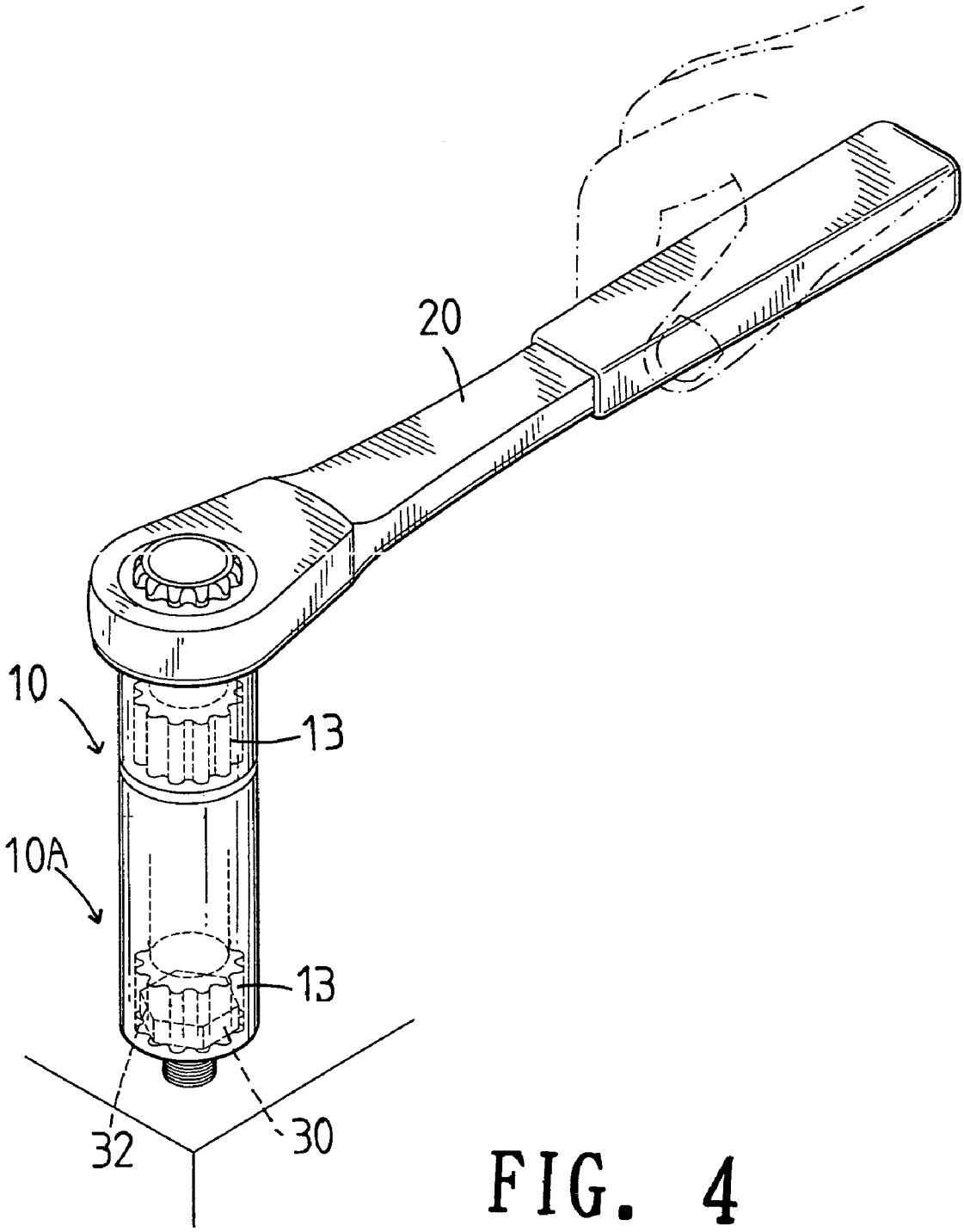
FIG. 4 is a perspective assembly view of the socket and the ratchet wrench in accordance with the preferred embodiment of the present invention.
Figure 5:
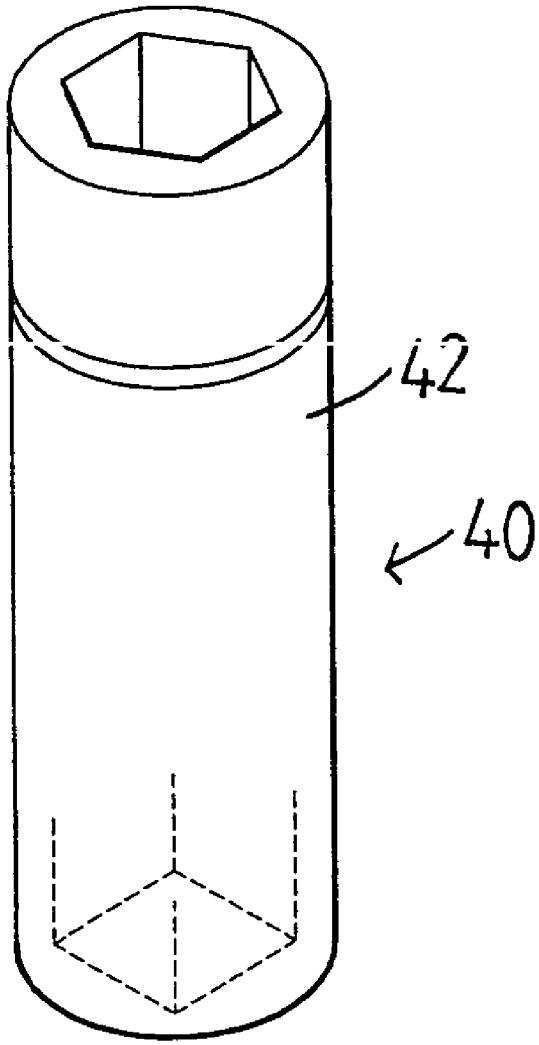
FIG. 5 PRIOR ART
FIG. 5 is a perspective view of a conventional socket in accordance with the prior art.

As shown in FIG. 4, the main body 10A of a second socket is mounted on the main body 10 of the first socket, with the twelve outer teeth 12 of the main body 10A of the second socket meshing with the twelve inner teeth 13 of the main body 10 of the first socket, and with the twelve inner teeth 13 of the main body 10A of the second socket being rested on the six faces 32 of the nut 30. Thus, the sockets can co-operate with each other to increase the working length, so that the sockets and the ratchet wrench 20 can be used in an elongated shallower space.

Accordingly, the twelve outer teeth 12 of the main body 10 of the socket mesh with the twelve inner teeth 23 of the drive head 21 of the ratchet wrench 20, so that the driving torque of the drive head 21 of the ratchet wrench 20 is distributed to the twelve outer teeth 12 of the main body 10 of the socket and the twelve inner teeth 23 of the drive head 21 of the ratchet wrench 20 evenly and smoothly, without producing a stress concentration effect, thereby preventing the main body 10 of the socket and the drive head 21 of the ratchet wrench 20 from being broken or worn out due to an excessive torque so as to increase the lifetime of the socket and the ratchet wrench 20. In addition, the inner teeth 13 of the main body 10 and the outer teeth 12 of the main body 10 have the same tooth number and have the corresponding tooth shape, so that the sockets can co-operate with each other to increase the working length, and the sockets co-operating with the ratchet wrench 20 can be used in an elongated shallower space. Further, the socket includes inner teeth and outer teeth having the same tooth number and have the corresponding tooth shape, so that any two sockets can be connected with each other so as to increase the whole length.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A socket, comprising a main body including a first cylinder, and a second cylinder integrally formed on the first cylinder, wherein:

the first cylinder of the main body has an outer periphery formed with a plurality of outer teeth;

the second cylinder of the main body has an inner periphery formed with a plurality of inner teeth;

the inner teeth of the second cylinder of the main body and the outer teeth of the first cylinder of the main body have the same tooth number and have the corresponding tooth shape;

each of the outer teeth of the first cylinder of the main body has an arcuate shape;

each of the inner teeth of the second cylinder of the main body has an arcuate shape;

the first cylinder of the main body is formed with twelve outer teeth;

the outer teeth of the first cylinder of the main body are arranged in an annular manner; the outer periphery of the first cylinder of the main body is formed with a plurality of arcuate recesses located between the outer teeth;

the first cylinder of the main body is formed with twelve recesses;

the second cylinder of the main body is formed with twelve inner teeth;

the inner teeth of the second cylinder of the main body are arranged in an annular manner;

the inner periphery of the second cylinder of the main body is formed with a plurality of arcuate recesses located between the inner teeth;

the second cylinder of the main body is formed with twelve recesses; the inner teeth of the second cylinder of the main body and the outer teeth of the first cylinder of the main body have the same tooth size so that when any two sockets are connected with each other, the outer teeth of the first cylinder of a first socket are correspondingly inserted into and engaged with the inner teeth of the second cylinder of a second socket;

the inner teeth of the second cylinder of the main body are in line with the outer teeth of the first cylinder of the main body;

the socket further comprising a ratchet wrench including a drive head having an inner periphery formed with a plurality of arcuate inner teeth;

the drive head of the ratchet wrench is formed with twelve inner teeth;

the inner periphery of the drive head of the ratchet wrench is formed with a plurality of arcuate recesses located between the inner teeth.

* * * * *